US006726081B1

(12) United States Patent
Lin

(10) Patent No.: US 6,726,081 B1
(45) Date of Patent: Apr. 27, 2004

(54) STAPLING APPARATUS WITH A SAFETY DEVICE FOR STAPLERS TO PREVENT STAPLES FROM POPPING OUT OF A STAPLER

(76) Inventor: Jui-Yuan Lin, No. 141, Hsinjen 6th St., Tali, Taichung Hsien (TW)

( * ) Notice: Subject to any disclaimer, the term of this patent is extended or adjusted under 35 U.S.C. 154(b) by 0 days.

(21) Appl. No.: 10/369,891

(22) Filed: Feb. 19, 2003

(51) Int. Cl.[7] ..... B25C 1/04
(52) U.S. Cl. ..... 227/123; 227/127; 227/134
(58) Field of Search ..... 227/123, 128, 227/134, 127, 124

(56) References Cited

U.S. PATENT DOCUMENTS 2,300,277 A * 10/1942 Hansen ..... 227/123
2,420,258 A * 5/1947 Maynard ..... 227/83
2,472,032 A * 5/1949 Wandel ..... 227/123
2,795,787 A * 6/1957 Spencer ..... 227/124
3,853,257 A * 12/1974 Perkins ..... 227/123
4,452,388 A * 6/1984 Fealey ..... 227/132
4,619,394 A * 10/1986 Knispel et al. ..... 227/156
5,350,103 A * 9/1994 Monacelli ..... 227/8
6,367,676 B1 * 4/2002 Opland et al. ..... 227/123

* cited by examiner

*Primary Examiner*—Scott A. Smith
(74) *Attorney, Agent, or Firm*—Dellett & Walters

(57) ABSTRACT

A stapling apparatus with a safety device for a stapler prevents staples from popping out of the stapler when a user wants to remove jammed or lodged staples. The stapling apparatus is pivotally attached to a stapler and has a housing with a front, a sliding front cover slidably mounted on the front of the housing so lodged staples can be conveniently removes and a safety device. The safety device includes a positive stop formed on the housing and a stop lip formed on the sliding front cover corresponding to the positive stop. When the user pushes the sliding front cover upward to remover lodged staples, the stop lip abuts the positive stop to limit movement of the sliding front cover. Therefore, the staples can be seen but are still held in the housing by the sliding front cover.

2 Claims, 5 Drawing Sheets

STAPLING APPARATUS WITH A SAFETY DEVICE FOR STAPLERS TO PREVENT STAPLES FROM POPPING OUT OF A STAPLER

BACKGROUND OF THE INVENTION

1. Field of the Invention

The present invention relates to a stapling apparatus with a safety device, and more particularly to a stapling apparatus with a safety device for a stapler that prevents staples in a stapler from popping out of the stapler.

2. Description of Related Art

A stapler is a device to connect pieces of paper by means of a staple. With reference to FIG. 4, a conventional stapler (20) comprises a first lever (21), a second lever (22), a stapling apparatus (23) in accordance with prior art and a sliding front cover (24). The two levers (21, 22) are pivotally connected by a pivot pin (not numbered). The first lever (21) has a front end (not shown) opposite the pivot pin. The stapling apparatus (23) is mounted around the front end of the first lever (21) and is pivotally attached to the pivot pin. The stapling apparatus (23) comprises a stapling assembly (not shown), a track (232) and a pushing device (233). The pushing device (233) has a compressed spring (234) that creates a resilient force. A set of staples (50) is slidably mounted on the track (232). The set of staples (50) is held on the track (232) in the stapler (20) by the resilient force of the compressed spring (234) pushing the set of staples (50) into a position where one staple in the set of staples (50) will be pressed by the stapling assembly to connect pieces of paper together. The sliding front cover (24) is movably attached to the stapling apparatus (23) at the front of the first lever (21). The sliding front cover (24) can be pushed upward to conveniently troubleshoot the stapler (20) when the stapler (20) has a problem.

Occasionally, one of the staples in the set of staples (50) in the stapler (20) will jam or may not be fed smoothly while stapling. Generally, such a state is caused by one of the stapes in the set staples (50) being bent or otherwise jammed in the stapling assembly (23) to keep the stapler (20) from functioning. One way to solve the problem is to remove the staple lodged in the stapling apparatus (23) of the stapler (20) or clear the jammed staple of the set of staples (50). Pushing the sliding front cover (24) upward will provide access to quickly find and easily remove the staple lodged in the stapling apparatus (23). However, when the staple lodged in stapler (20) is removed, the remaining set of staples (50) will be released and pop out of the stapling apparatus (23) because of the resilient force of the pushing device (233). The conventional stapling apparatus of the stapler (20) does not have any safety device to prevent the set of staples (50) in the stapler (20) from popping out of the stapler (20). The conventional stapler (20) is potentially hazardous for a user when the user has to remove a staple lodged in the stapler (20). The ejected staples (50) may injure the user, especially the eyes or somebody near the user.

To overcome the shortcomings, the present invention provides a stapling apparatus with a safety device for a stapler to mitigate or obviate the aforementioned problems.

SUMMARY OF THE INVENTION

The main objective of the invention is to provide a stapling apparatus with a safety device for a stapler that prevents staples in the stapler from suddenly popping out of the stapler when a user tries to remove a lodged staple that keeps the stapler from functioning.

Other objectives, advantages and novel features of the invention will become more apparent from the following detailed description when taken in conjunction with the accompanying drawings.

DETAILED DESCRIPTION OF PREFERRED EMBODIMENT

Figure 1:
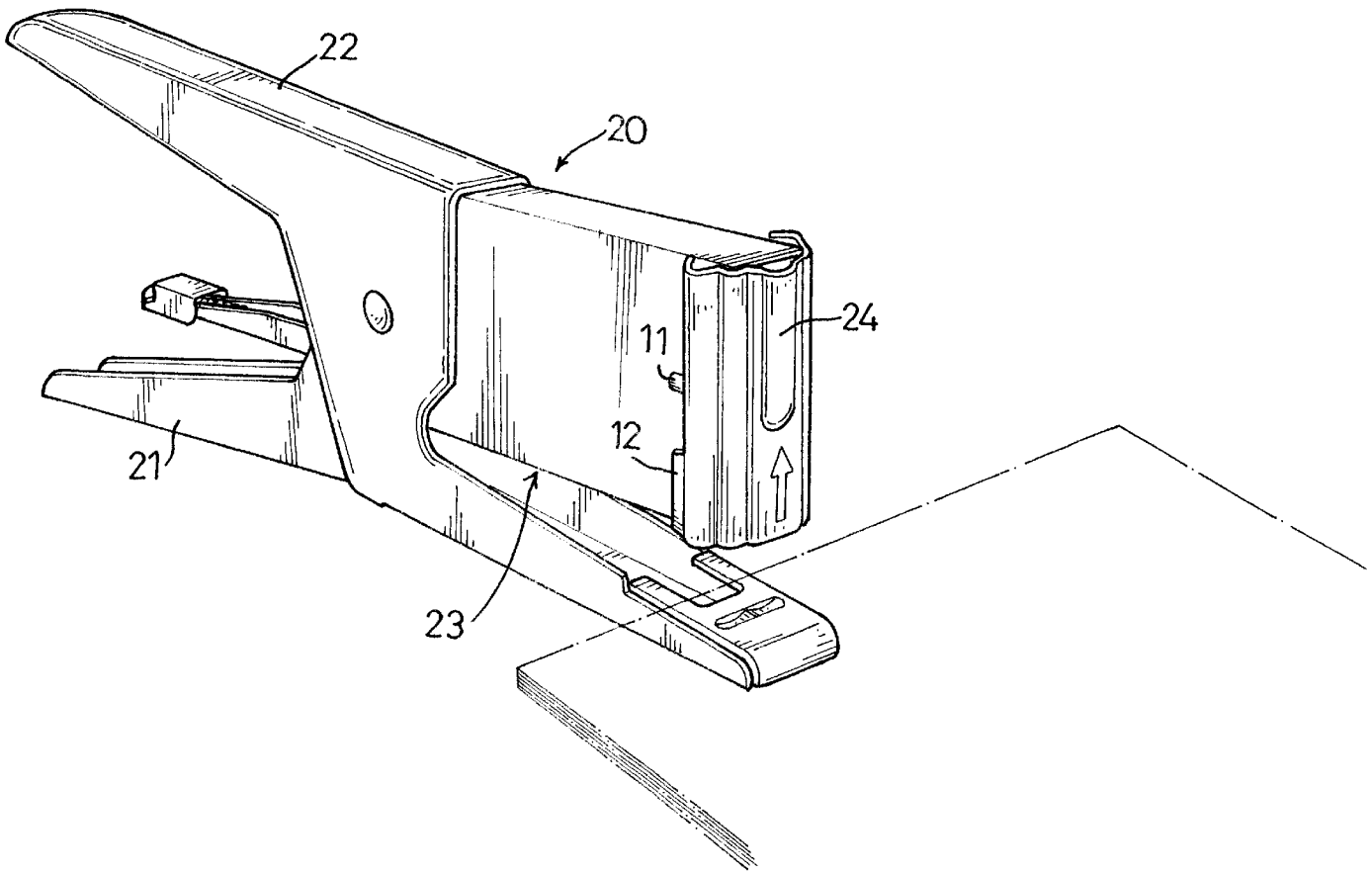
FIG. 1 is an operational perspective view of a stapler having a stapling apparatus with a safety device in accordance with the present invention.
Figure 2:
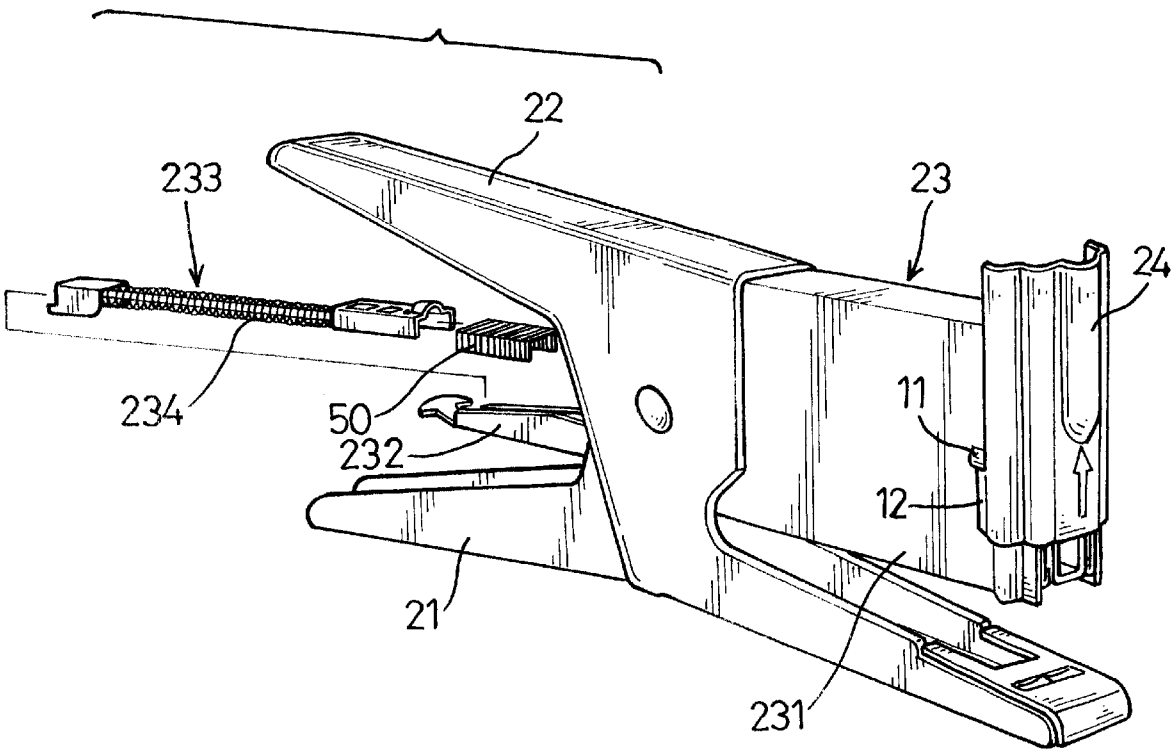
FIG. 2 is a partial exploded perspective view of the stapler in FIG. 1.

With reference to FIGS. 1 and 2, a stapling apparatus (23) with a safety device for a stapler (20) prevents a set of staples (50) in the stapler (20) from suddenly popping out of the stapler (20) when a user (not shown) tries to troubleshoot the stapler (20). The stapler (20) comprises a first lever (21) and a second lever (22) that are pivotally connected by a pivot pin (not numbered) and has the stapling apparatus (23) with a safety device in accordance with the present invention. Each of the first lever (21) and the second lever (22) has a front end (not shown).

The stapling apparatus (23) is pivotally attached to pivot pin at the front end of the first lever (21) and has a housing (231), a track (232), a pushing device (233), a stapling assembly (not shown) and a safety device (not numbered). The housing (231) has a front (not numbered), a rear (numbered), a bottom (not numbered) and two opposite sides (not numbered). The housing (231) is pivotally attached to the pivot pin and is mounted around the front end of the first lever (21). The track (232) is mounted in the housing (231) and has an enlarged end (not numbered) extending out of the rear of the housing (231). The stapling assembly, is conventional, is mounted in the housing (231) above the track (232) at the front end of the first lever (21) and is adapted to staple one of the set of staples (50) to fasten paper.

The set of staples (50) is adapted to be slidably mounted on the track (232) and has a top (not numbered). The track (232) allows the set of staples (50) to slidably move toward the front of the housing (231) where one staple (50) is pressed to fasten pieces of paper together by the stapling assembly. To push the set of staples (50) toward the front of the housing (231), the pushing device (233) is attached to the track (232) between the set of staples (50) and the enlarged end of the track (232). The pushing device (233) has a compressed spring (234) that provides a resilient force to push the set of staples (50) toward the front of the housing (231).

When the two levers (21, 22) are squeezed toward each other, the housing (231) is firstly pivoted by the first lever

(21) until it abuts the second lever (22). By continuously squeezing the two levers (21, 22) together, the front end of the first lever (21) will pivotally drive the stapling assembly to press one staple in the set of staples (50) and staple the paper.

The sliding front cover (24) has a bottom (not numbered) and two opposite sides (not numbered). The sliding front cover (24) is movably attached to the front of the housing (231) to allow convenient access to the stapler (20) to clear a staple (not shown) lodged in the housing (231) that keeps the stapler (20) from functioning properly.

The safety device is formed on the housing (231) and the sliding front cover (24) and comprises a positive stop (11) and a stop lip (12). The positive stop (11) is formed on and protrudes from one side of the housing (231) adjacent to the sliding front cover (24). The stop lip (12) protrudes from the sliding front cover (24) at one side below the positive stop (11) and corresponds to the positive stop (11).

Figure 3A:
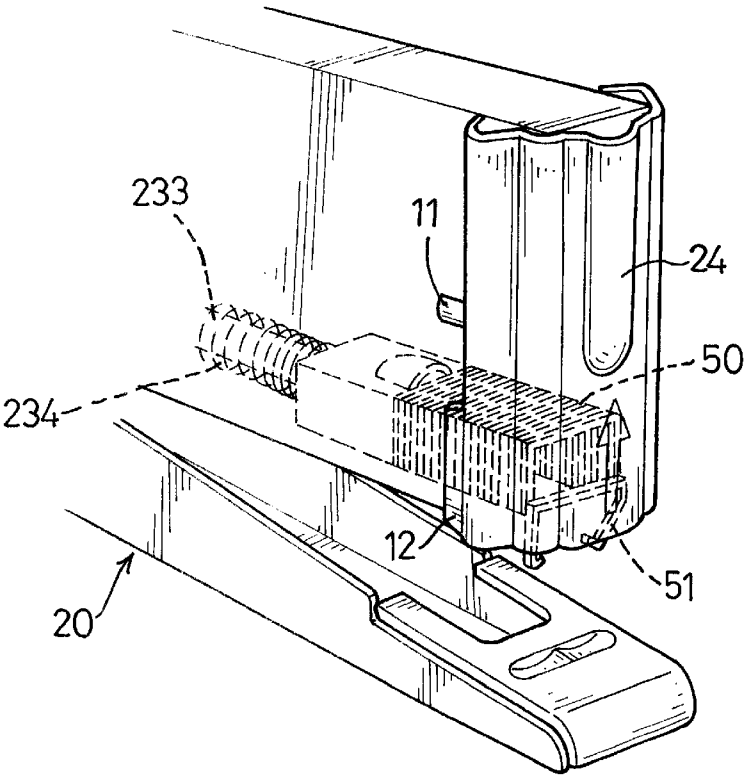
FIG. 3*a* is an enlarged perspective view of the stapler in FIG. 1 with a bent staple that causes the stapler to breakdown.
Figure 3B:
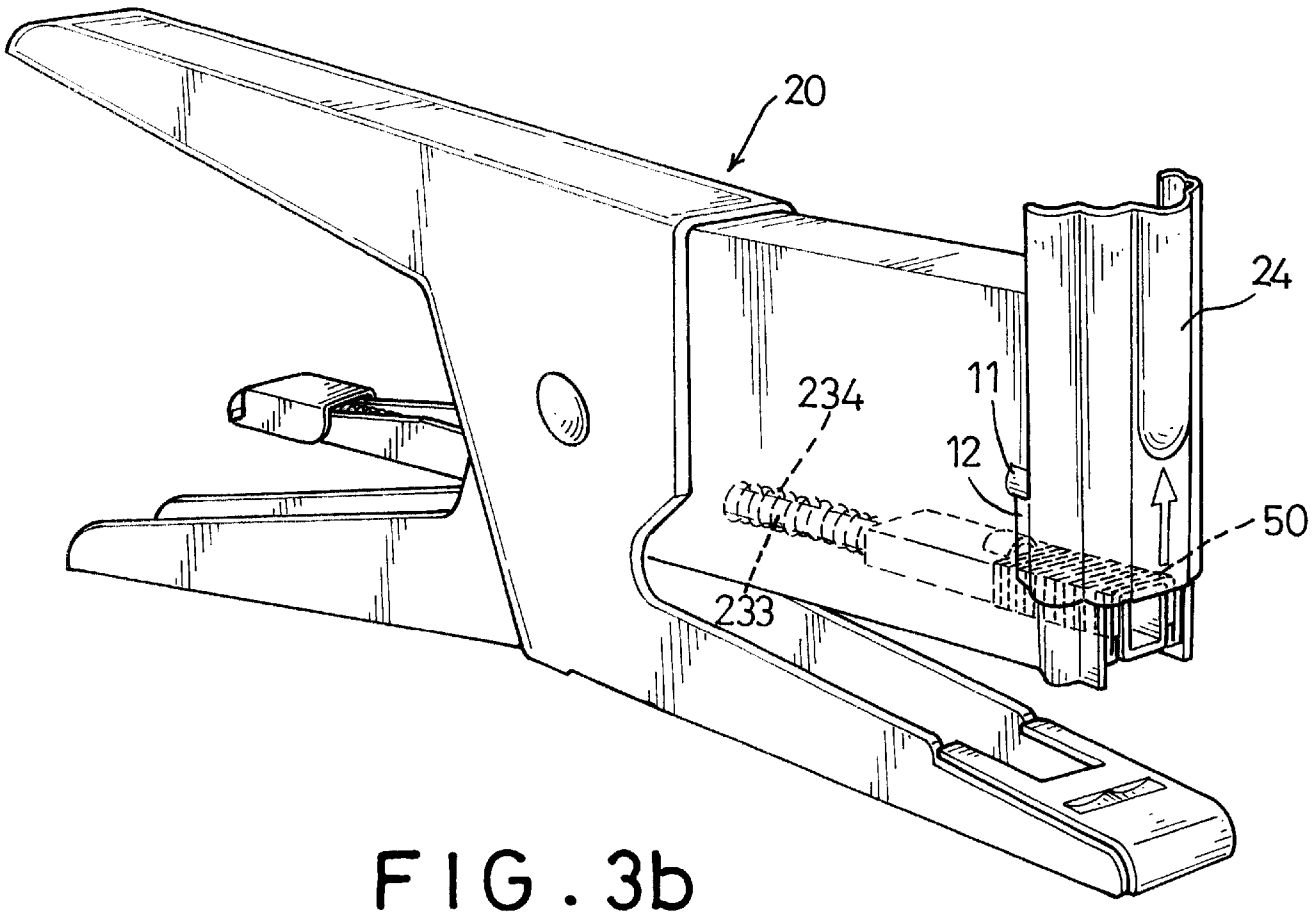
FIG. 3*b* is an enlarged perspective view of the stapler in FIG. 1 when a sliding front cover is pushed upward and the staples can be seen to perform troubleshooting.
Figure 4:
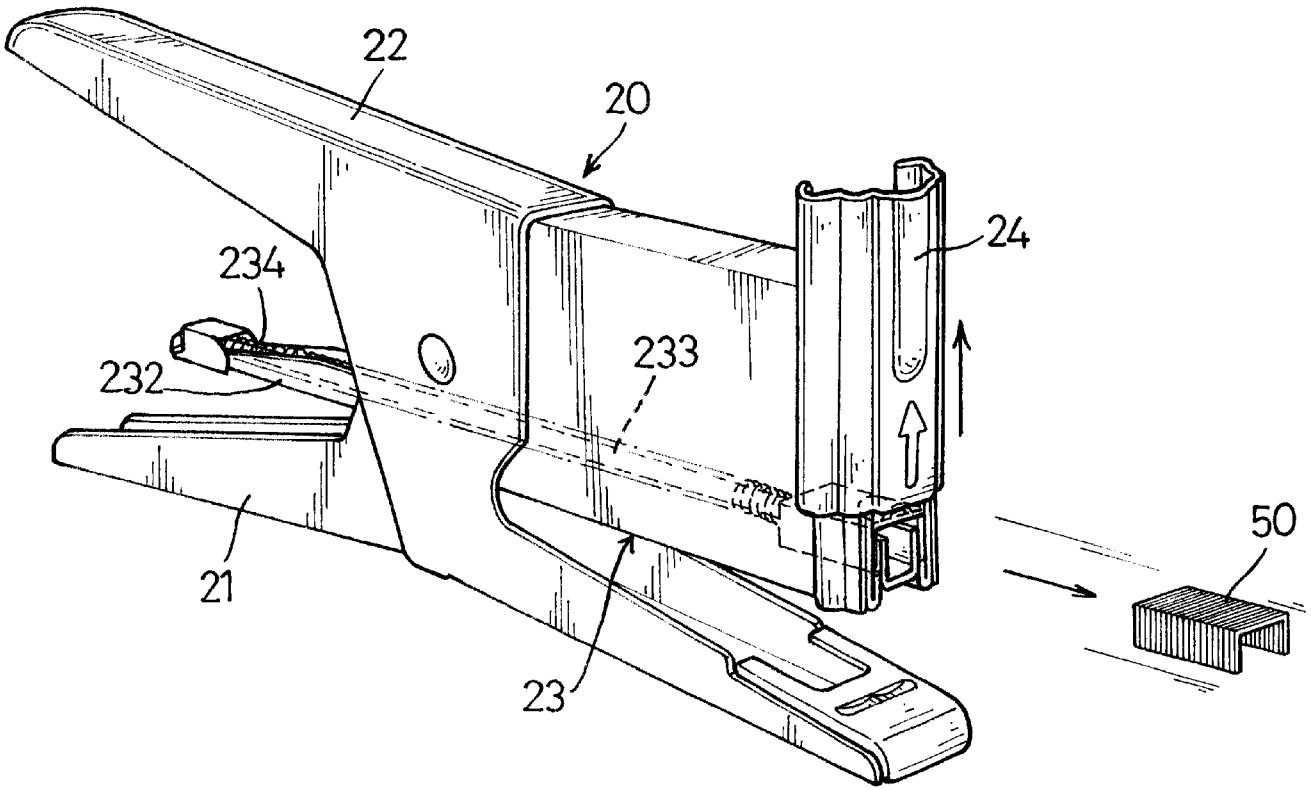
FIG. 4 PRIOR ART
FIG. 4 is a perspective view of a conventional stapler in accordance with the prior art with the staples is popping out of the stapler when the sliding front cover is pushed up.

With reference to FIGS. 3*a* and 3*b*, removing a bent staple (51) or jammed staples (not shown) from the stapler (20) requires that the sliding front cover (24) be pushed upward to quickly remove the bent staple (51) lodged in the stapler (20). When the sliding front cover (24) is pushed upward, the stop lip (12) will abut the positive stop (11) and will keep the sliding front cover (24) from moving up any further. With the stop lip (12) abutting the positive stop (11), the bottom of the sliding front cover (24) is lower that the top of the set of staples (50). Thereafter, the lodged bent staple (51) can be easily found and removed or jammed staples are easily to be rearranged. In any case, the set of staples (50) are still held on the track (232) in the housing (231) by the sliding front cover (24), and the stapler (20) is immediately used to connect or fasten pieces of paper together after the lodged bent staple (51) is removed.

The safety device prevents any possibility of the set of staples (50) on the track (232) from popping out of the housing (231) as the sliding front cover (24) is pushed upward. Without the safety device, the stapler (20) is quite a dangerous piece of office equipment for a user who perhaps uses it everyday. The safety device for the stapler (20) enhances the safety of the stapler (20) as described in the foregoing description. The stapler (20) with the safety device operates safely and prevents the user away from being injured.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A stapling apparatus with a safety device for a stapler having a first lever with a front end and a second lever pivotally connected together by a pivot pin, the stapling apparatus comprising a housing adapted to be pivotally attached to the pivot pin and mounted around the front end of the first lever and having a front, a bottom and two opposite side;

a track mounted in the housing and adapted to position a set of staples with a top toward the front of the housing;

a pushing device attached to the track and having a compressed spring that provides a resilient force to push the set of staples toward the front of the housing;

a stapling assembly mounted in the housing above the track at the front end of the first lever and adapted to staple one of the set of staples to fasten paper together;

a sliding front cover having a bottom and two opposite sides slidably mounted on the front of the housing to conveniently remove staples that are jammed; and a safety device attached between the housing and the front slide cover and the safety device comprising a positive stop formed on the housing adjacent to the sliding front cover; and a stop lip formed on the sliding front cover and corresponding to the positive stop, where the positive stop abuts the stop lip to limit movement of the sliding front cover such that the bottom of the sliding front cover is lower than the top of the set of staples whereby the set of staples are held on the track in the housing by the sliding front cover when the sliding front cover is pushed upward when troubleshooting the stapler.

2. The stapling apparatus as claimed in claim 1, wherein the positive stop is formed at one side of the housing adjacent to the sliding front cover; and the stop lip is formed at one side of the sliding front cover and corresponds to the positive stop.

* * * * *